US005407272A

United States Patent [19]

Meier

[11] Patent Number: 5,407,272

[45] Date of Patent: Apr. 18, 1995

[54] DOUBLE IMPELLER FOR STIRRING STERILE LIQUIDS

[75] Inventor: Hans P. Meier, Jona, Switzerland

[73] Assignee: Mavag Verfahrenstechnik AG., Altendorf, Switzerland

[21] Appl. No.: 129,442

[22] Filed: Sep. 30, 1993

[30] Foreign Application Priority Data

Oct. 1, 1992 [DE] Germany ..... 42 32 934.5

[51] Int. Cl.[6] ..... B01F 13/08; B01F 7/22

[52] U.S. Cl. ..... 366/274; 366/314; 366/327; 366/330

[58] Field of Search ..... 366/273, 274, 314, 205, 366/325, 327, 328, 329, 330, 331, 279

[56] References Cited

U.S. PATENT DOCUMENTS

| | | | |
|---|---|---|---|
| 2,350,534 | 6/1944 | Rosinger | 366/274 |
| 2,459,224 | 1/1949 | Hendricks | 366/274 |
| 2,566,743 | 9/1951 | Okulitch | 366/273 |
| 2,771,111 | 11/1956 | Seyfried | 366/205 |
| 3,024,010 | 3/1962 | Sperling | 366/314 |
| 3,250,519 | 5/1966 | Herfeld | 366/314 |
| 3,863,903 | 2/1975 | Brehmer | 366/274 |
| 4,209,259 | 6/1980 | Rains | 366/273 |
| 4,462,694 | 7/1984 | Ernster | 366/314 |
| 4,653,519 | 3/1987 | Kanner | 366/273 |
| 4,993,841 | 2/1991 | Löfgren et al. . | |
| 5,061,079 | 10/1991 | Shiobara . | |

FOREIGN PATENT DOCUMENTS

| | | |
|---|---|---|
| 0360767 | 3/1990 | European Pat. Off. . |
| 0399972 | 11/1990 | European Pat. Off. . |
| 3238647 | 5/1984 | Germany . |
| 3737150 | 6/1988 | Germany . |
| 2151937 | 7/1985 | United Kingdom . |
| 1563745 | 2/1991 | U.S.S.R. . |

*Primary Examiner*—Robert W. Jenkins
*Attorney, Agent, or Firm*—Michael J. Striker

[57] ABSTRACT

An impeller for stirring has an impeller head having a central hollow chamber with an opening, a stirring tool provided on the impeller head, and a driving pin received in the opening. The stirring tool is formed as a propeller having a rotary direction which produces an upwardly directed flow and provided in a lower region with flow producing surfaces which form an additional flow directed opposite to the flow produced by the propeller.

12 Claims, 2 Drawing Sheets

DOUBLE IMPELLER FOR STIRRING STERILE LIQUIDS

BACKGROUND OF THE INVENTION

The present invention relates to a double impeller for stirring particularly sterile liquids. More particularly, it relates to an impeller which has an impeller head with a stirring tool and a lower opening for receiving a pin in a central hollow chamber, wherein the impeller is driveable inductively or magnetically in a contactless manner.

Such an impeller is disclosed for example in U.S. Pat. No. 928,841 and in the European patent document EP-A10399972. The impeller has a plurality of radially outwardly extending stirring blades forming a stirring tool. When the impeller is arranged in a container a flow is produced which forms in the container a liquid whirl flow with the impeller as a center point. A negative pressure is formed above the impeller and under the action of suction, the upper surface of the liquid lowers conically in direction of the impeller. The negative pressure acting in this region is not desirable since it contributes to the entrapment of the gasses into the liquid and in some liquids can form foams.

SUMMARY OF THE INVENTION

Accordingly, it is an object of the present invention to provide an impeller for stirring sterile liquids, which produces a different flow in the container which also has an improved mixing and stirring action.

In keeping with these objects and with others which will become apparent hereinafter, one feature of the present invention resides, briefly stated, in an impeller in which the stirring tool is formed as a propeller having a rotary direction which produces an upwardly directed flow and is provided in its lower region with additional flow-producing surfaces which can produce a flow opposite to the flow caused by the propeller and directed downwardly or laterally.

The negative pressure available in the center is more or less compensated by the upwardly directed flow produced by the propeller, so that the undesirable gas entrapment is avoided. The effects of the foam formation are eliminated. Due to the opposite flow in the lower region, the axial forces of the propeller are partially compensated. The service life of the bearings is advantageously increased.

In accordance with further embodiment of the invention the lower flow-producing surfaces are formed as vanes of the impeller. Depending on the position and size of the vanes the axial forces acting on the impeller can be almost completely compensated.

In accordance with another embodiment of invention the lower flow-producing surfaces are formed as turbine-shaped lower end surfaces of the impeller. Even with low filling heights the stirring action is thereby maintained.

In accordance with further embodiment, at least one connecting conduit can be provided between the central hollow chamber and the outer surface. In this construction the inner hollow chamber of the impeller is constantly sprayed with liquid which facilitates the cleaning of the impeller.

The best stirring action is obtained when the propeller is arranged at distance from the lower impeller end surface which corresponds to ½ of the propeller diameter, preferably 1½.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
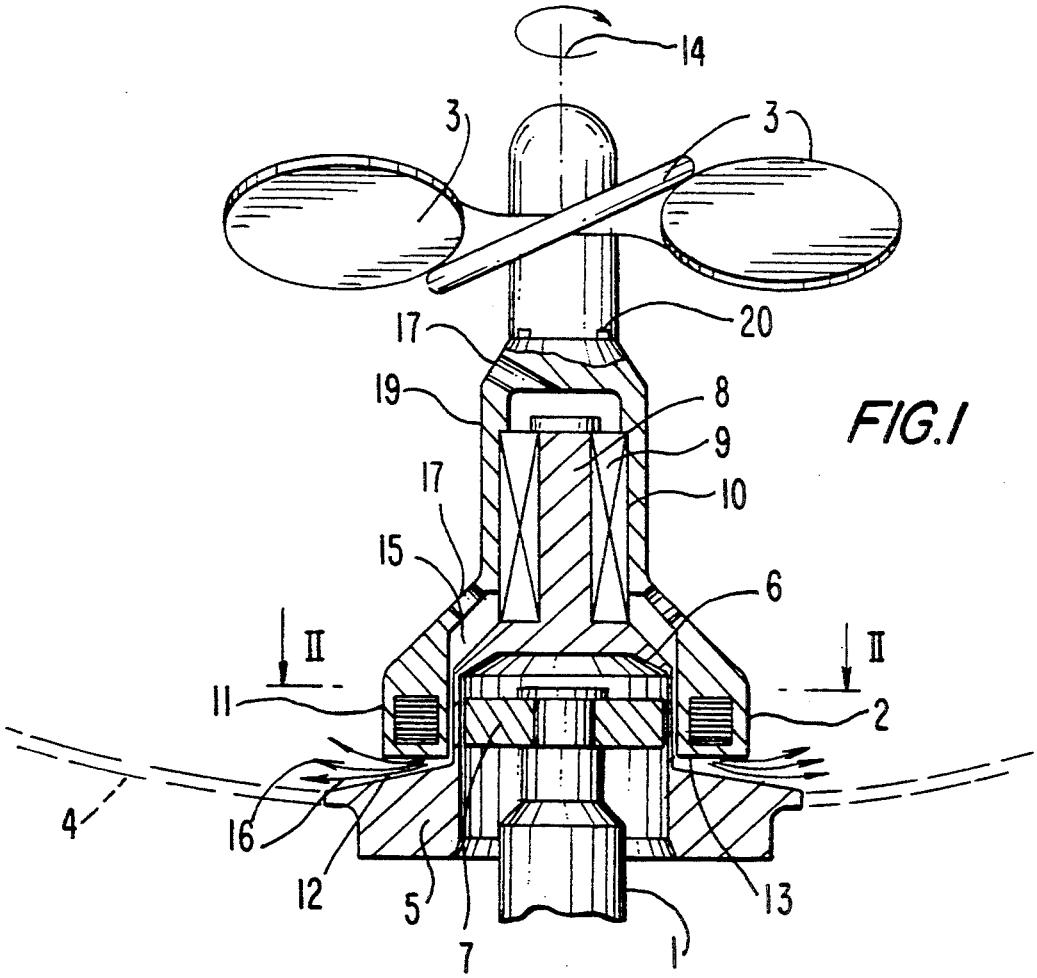
FIG. 1 is a view showing an axial section of a double impeller in accordance with the present invention with a turbine-like lower end surface.

An impeller in accordance with the present invention has a drive unit which is not shown in detail and has a drive shaft identified with reference numeral 1. The drive shaft drives an impeller head 2 which carries on a shaft end 20 a stirring tool formed as a propeller with several propeller blades 3. The impeller head is arranged in a lower part of the container having a lower container wall 4 identified in broken lines. A mounting flange 5 is welded in the wall 4. It has a pin 6 which extends into the container and is hollow. The drive shaft 1 extends into the hollow chamber of the pin 6, and a magnetic disk 7 provided with several permanent magnets is fixed to the shaft on its upper end.

The mounting flange 5 in many incidences is composed of non-magnetic steel. The upper part of the pin 6 is formed as a cylindrical seating surface 8 of a bearing 9. The bearing 9 is provided for fixation of the impeller head 2 with a recessed seating surface 10. A plurality of oppositely polarized permanent magnets 11 are arranged in the interior of the impeller head 2 opposite to the magnet disk 7. Therefore a torque is transmitted from the drive shaft 1 to the impeller head 2 due to the magnetic forces between the magnet disk 7 and the permanent magnets 11 in a contactless manner.

The lower end surface 12 of the impeller head 2 is formed with correspondingly milled grooves 13. As a result during rotation of the impeller head 2 a pumping effect is produced.

Figure 2:
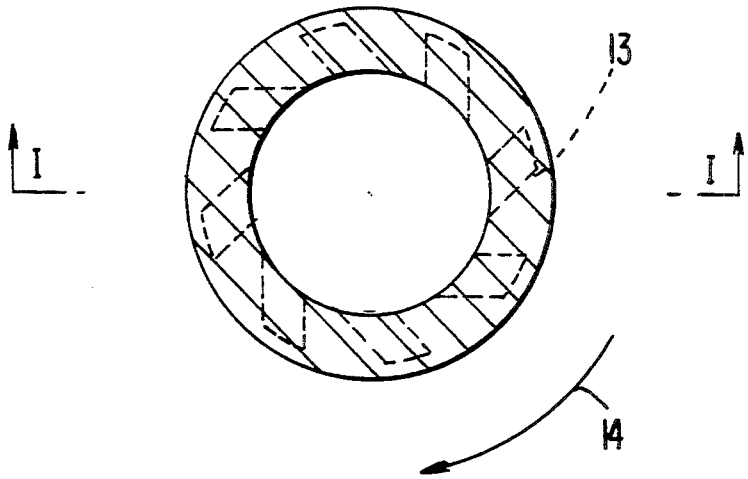
FIG. 2 is a view showing a horizontal section taken along the line II—II in FIG. 1.
Figure 3:
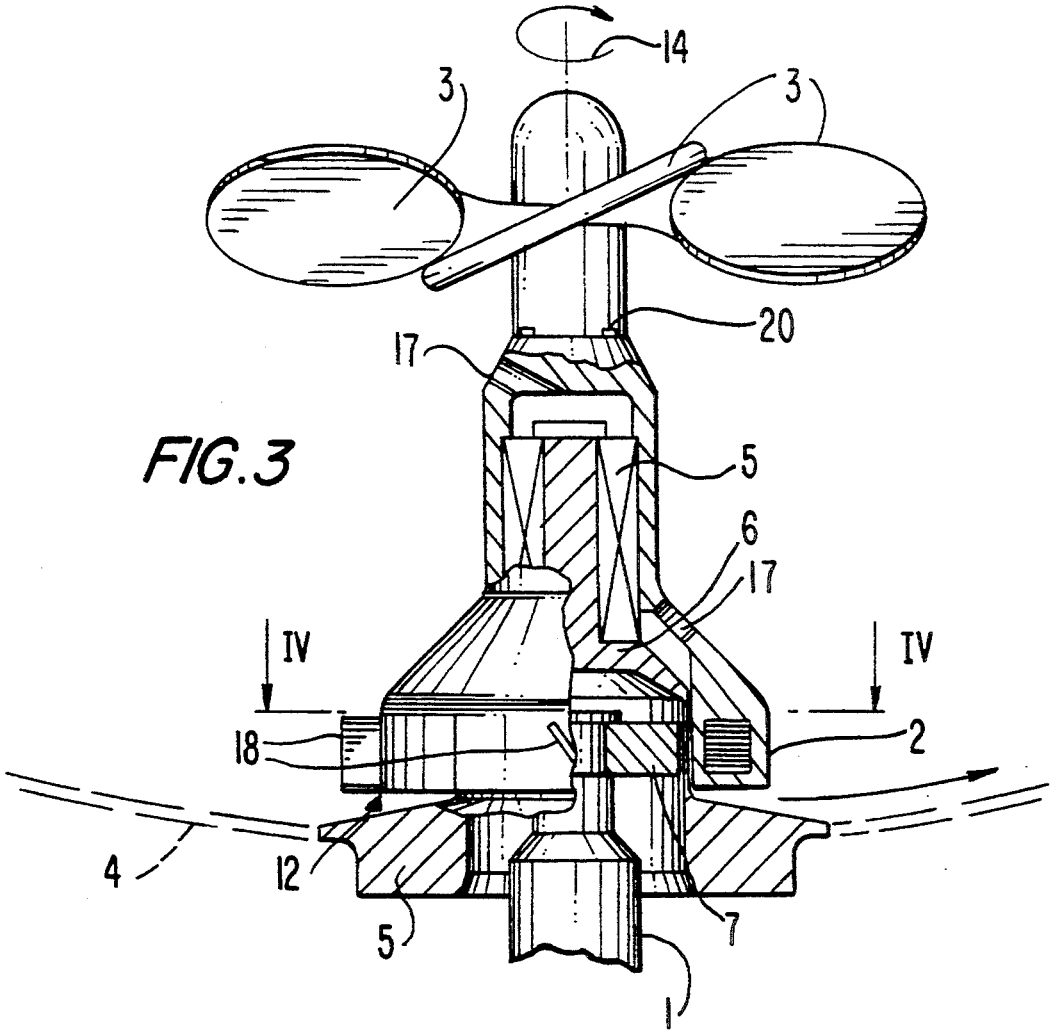
FIG. 3 is a view showing an axial section through an inventive double impeller with vanes provided in its lower regions.
Figure 4:
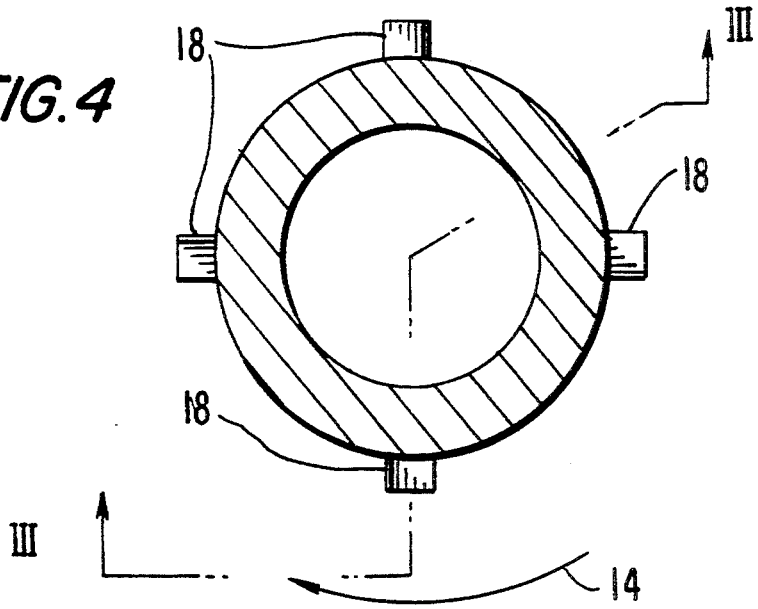
FIG. 4 is a view showing a horizontal section taken along the line IV—IV in FIG. 3.

FIG. 2 shows a horizontal section of the impeller head according to section line II—II in FIG. 1. For the sake of clarity of illustration the parts of the container are removed. The grooves 13 are shown in broken lines. Since the grooves 13 are arranged similarly to the vane wheel, during the rotation of the impeller head 2 a pumping effect is produced in the direction of arrow 14. It produces a flow which is directed outwardly from the hollow chamber 14 of the impeller head 2 as identified with the arrow 16. The aspirated fluid finally flows from the central hollow chamber 15 through the conduit 17 which communicates the hollow chamber 15 with the surface 19 of the impeller head 2.

The propeller blades 3 are arranged so that during the rotation of the impeller head due to the stirring forces downwardly directed axial force is formed as a reaction force to the vertically upwardly directed flow.

Since the lower surface 12 of the impeller head is formed as a pump rotor, during driving in the direction of the arrow 14 a negative pressure is produced in the hollow chamber 15 and provides an additional axial force which is also directed downwardly. When additional vanes 18 are arranged on the impeller head 2 so that during a rotation of the impeller in the direction of arrow 14 an additional downward directed flow is produced, the axial forces of the propeller blades 3 are partially compensated and an especially intensive stirring and mixing action in the container fluid is produced without undesirably affecting the service life of the bearing.

The turbine-like design of the lower end surface 12 of the impeller as well the vanes 18 in the lower region of the impeller can be also combined in their operation.

Thereby an impeller head produces the especially intensive stirring and mixing action which with low filling heights under the level of the propeller vanes still provides a stirring action. Moreover, it is suitable especially for the bio-technological applications, for example in fermenters, in view of its self-cleaning construction. In such applications the flow field of a different type is also suitable since the construction counteracts the foam formation.

It will be understood that each of the elements described above, or two or more together, may also find a useful application in other types of constructions differing from the types described above.

While the invention has been illustrated and described as embodied in an impeller for stirring sterile liquids or the like, it is not intended to be limited to the details shown, since various modifications and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An impeller for stirring, comprising a stirring tool; a rotatable impeller head having a substantially vertical axis of rotation and carrying said stirring tool to rotate the latter; means for rotatably driving said impeller head about said axis of rotation, said stirring tool having a plurality of propeller blades arranged so that during rotation of said stirring tool a liquid flow is produced in a predetermined direction, said impeller head having a lower region provided with a flow producing surface formed so that an additional flow is provided which is directed opposite to said flow produced by said propeller blades, said impeller head having a hollow chamber and an outer surface, and a conduit which connects said hollow chamber with said outer surface.

2. An impeller as defined in claim 1, wherein said driving means are contactless inductive driving means.

3. An impeller as defined in claim 1, wherein said driving means are contactless magnetic driving means.

4. An impeller as defined in claim 1, wherein said flow-producing surfaces are formed as vanes provided on a lower surface of said impeller head.

5. An impeller as defined in claim 1, wherein said flow producing surfaces are formed as a turbine-shaped lower end surface of said impeller head.

6. An impeller as defined in claim 1, wherein said impeller head has a lower end surface, said stirring tool being spaced from said lower end surface by a distance equal to ½ of a propeller blades outer diameter.

7. As defined in claim 6, wherein said distance is equal to 1½ the propeller blades outer diameter.

8. An impeller as defined in claim 1; and further comprising a pin extending into an interior of said impeller head and rotatably supporting said impeller head for rotation about said axis.

9. An impeller as defined in claim 1, wherein said propeller blades are formed so that the flow produced by the propeller blades is directed upwardly, said flow producing surfaces of said impeller head being formed so that the additional flow produced by said flow producing surfaces is directed downwardly.

10. An impeller as defined in claim 1, wherein said propeller blades are formed so that the flow produced by the propeller blades is directed upwardly, said flow producing surfaces of said impeller head being formed so that the additional flow produced by said flow producing surfaces is directed laterally.

11. An impeller as defined in claim 1, wherein said means for rotatably driving said impeller head include a drive shaft and magnetic means for transmitting a rotation of said drive shaft to said impeller head in a contactless manner.

12. An impeller as defined in claim 1, wherein said stirring tool rotates in the rotary direction, said propeller blades of said stirring tool being inclined relative to said rotary direction so as to provide the liquid flow in said predetermined direction.

* * * * *